US009935402B2

(12) United States Patent
Curry et al.

(10) Patent No.: US 9,935,402 B2
(45) Date of Patent: Apr. 3, 2018

(54) ELECTRICAL CONNECTOR ASSEMBLY HAVING CONNECTOR BODIES AND REMOVABLE CAPS

(71) Applicant: HOBBICO, INC., Champaign, IL (US)

(72) Inventors: Shane Curry, Champaign, IL (US); Neal Cloud, Tolono, IL (US); Kevin Burner, Champaign, IL (US); Robert Csiki, Mahomet, IL (US); Jamie M. Seymour, Mission Viejo, CA (US)

(73) Assignee: Hobbico, Inc., Champaign, IL (US)

( * ) Notice: Subject to any disclaimer, the term of this patent is extended or adjusted under 35 U.S.C. 154(b) by 75 days.

(21) Appl. No.: 14/987,342

(22) Filed: Jan. 4, 2016

(65) Prior Publication Data

US 2016/0118749 A1 Apr. 28, 2016

Related U.S. Application Data

(63) Continuation of application No. 29/499,191, filed on Aug. 12, 2014, now Pat. No. Des. 749,046.

(51) Int. Cl.
*H01R 13/516* (2006.01)
*H01R 13/6581* (2011.01)

(52) U.S. Cl.
CPC ..... *H01R 13/6581* (2013.01); *H01R 13/516* (2013.01)

(58) Field of Classification Search
CPC ..... H01R 13/6581; H01R 13/516
USPC ..... 439/796, 901, 904, 905, 599, 701, 712, 439/695, 296, 368, 521, 533, 540.1, 298, 439/686, 652, 678, 732, 903, 752, 718
See application file for complete search history.

(56) References Cited

U.S. PATENT DOCUMENTS 4,518,217 A 5/1985 Corrigan, III
4,583,968 A 4/1986 Mahurkar
4,601,528 A * 7/1986 Spier ..... H01R 13/5219 439/148

(Continued)

OTHER PUBLICATIONS

PowerBox Systems, "Deans-PIK extension", <https://www.powerbox-systems.com/produkte/kabel/deans-pik/deans-pik-verlaengerung.html>, 2014, 3 pages.

(Continued)

*Primary Examiner* — Renee Luebke
*Assistant Examiner* — Paul Baillargeon
(74) *Attorney, Agent, or Firm* — Drinker Biddle & Reath LLP

(57) ABSTRACT

An electrical connector assembly is described. The electrical connector assembly includes a first connector body, a second connector body, a first removable cap, and a second removable cap. The first connector body has a first connector end, a first cap end, and first and second electrodes that protrude from the first cap end. The second connector body has a second connector end, a second cap end, and third and fourth electrodes that protrude from the second cap end. The first and second removable caps each have a cavity, formed by an outer wall portion that shields the corresponding electrodes, and an interior wall portion that shields at least a portion of the corresponding electrodes. Upon an engagement of the first and second connector bodies, the first connector end abuts the second connector end, the first and third electrodes are electrically connected, and the second and fourth electrodes are electrically connected.

14 Claims, 3 Drawing Sheets

(56) References Cited

U.S. PATENT DOCUMENTS

| | | | | |
|---|---|---|---|---|
| 5,425,657 | A | 6/1995 | Davis et al. | |
| 5,533,915 | A | 7/1996 | Deans | |
| 5,775,948 | A | 7/1998 | Madeley | |
| 6,619,996 | B2 | 9/2003 | Hara et al. | |
| 7,314,999 | B2 | 1/2008 | Dobler | |
| 7,374,460 | B1 | 5/2008 | Hariharesan et al. | |
| 7,530,855 | B2 | 5/2009 | Hariharesan et al. | |
| 7,641,500 | B2 | 1/2010 | Stoner et al. | |
| 8,182,297 | B2 * | 5/2012 | Lin | H01R 13/514 439/357 |
| 8,342,891 | B2 * | 1/2013 | Fukushi | H01R 4/4836 439/441 |
| 8,491,341 | B2 | 7/2013 | Bower et al. | |
| 8,641,440 | B2 | 2/2014 | Hariharesan et al. | |
| 8,944,843 | B2 * | 2/2015 | Keswani | H01R 4/4836 439/441 |
| 2011/0250873 | A1 | 10/2011 | Su et al. | |

OTHER PUBLICATIONS ebay, "5 Pack: (5) Male T-Plug Connectors (Deans Style) w/ SecureGrip & 5CM 12awg Wire", <http://www.ebay.com/itm/5-pack-5-Male-T-Plug-Connectors-Deans-Style-w-SecureGrip-5CM-12awg-Wire-/230852349783 #ht_473wt_1104>, 2014, 4 pages.

* cited by examiner

ELECTRICAL CONNECTOR ASSEMBLY HAVING CONNECTOR BODIES AND REMOVABLE CAPS

CROSS-REFERENCES TO RELATED APPLICATIONS

This disclosure is a continuation of U.S. Design patent application No. 29/499,191, entitled "Electrical Connector" and filed on Aug. 12, 2014, the disclosure of which is incorporated herein by reference in its entirety.

FIELD OF THE DISCLOSURE

The present disclosure relates generally to electrical connectors and, more particularly, to electrical connectors providing shielded electrical contacts.

BACKGROUND

With improvements in battery design, many battery-powered devices require that a relatively large amount of electrical current be carried when operating the battery-powered device. It is also common that this electrical current must be carried through an electrical connector so that a more fully charged battery can be easily plugged into the battery-powered device or that other control cables must be easily connected or disconnected. Because of the large amount of current flowing in such battery-powered devices, some electrical connectors have a risk of galling at the interface between a male and female connector which in turn would cause an increased electrical resistance. The increased electrical resistance can lead to a heating and often destruction of the electrical connector or reduced performance of the battery powered device.

An example of an electrical connector assembly capable of carrying a large amount of current is disclosed by Deans, U.S. Pat. No. 5,533,915 ("the '915 patent"). The '915 patent generally describes a male connector assembly 10 and a female connector assembly 11. A male connector pin 12 of the male connector assembly has a top 16, a bottom 17, a first side 18, a second side 19, a forward end 20, and a rearward end 21 and is fabricated from copper which has preferably been nickel plated followed by gold plating. A leaf spring 14 has a flat length 27 held within connector body 25 and a curved length 26 that extends past a face 28 of the connector body 25. Male conductors 42 and 43 are soldered near the rearward end 21 of each of the connector pins in a manner analogous to that shown on the female connector assembly 11.

The '915 patent also describes a female connector body 45 having a first side 46, a second side 47, a top 48, a bottom 49 and a back 50 and also a generally rectangular upper opening 51 and a lower generally rectangular opening 52 identical to 51 except that it is rotated 270 degrees as viewed in FIG. 7. Female connector pin 59 can be seen to have a top 60, a bottom 61, a forward end 62, a rearward end 63, a first side 64, and a second side 65. Connector pin 59 is shown in phantom view in FIG. 8 where it can be seen that the forward end 62 is recessed from the face 44. This helps to avoid any undesired contact of male connector pins 12 and 13 unless they are oriented properly so that they will pass beneath the face 44 of connector body 45. It can also be fairly seen in FIG. 1 that conductor 68 is soldered at 69 to a rearward portion of female connector pin 59 which extends past back 50 of conductor body 45. Similarly, conductor 70 is soldered at 71 to connector pin 59'. The connector pins 12, 13, 59, and 60 are connectable externally to the electrical connector assembly at their respective rearward portions. The connector pins 12, 13, 59, and 60 thus provide an external connection to the battery and/or battery-powered device via the conductors 42, 43, 68, and 70. In other words, the battery and battery-powered device are electrically connected via the conductors 42 and 43, the male connector pins 12 and 13, the female connector pins 59 and 60, and the conductors 68 and 70.

In operation of the connector assembly of the '915 patent, connector pins 12 and 13 are inserted into generally rectangular openings 51 and 52. The leaf spring 14 contacts the top 53 of rectangular opening 52, thereby forcing the leaf spring 14 of connector pin 12 against the top 60 of connector pin 59. This provides an effective contact area and yet the male and female connectors do not require excessive force to be plugged together or to be unplugged. The connector bodies are preferably fabricated from strong dielectric materials such as glass fiber reinforced nylon. The '915 patent indicates that when using a gold plated male connector and a silver plated female connector, it has been found that the resulting connection is capable of passing 30 amps from an 8 volt battery without any breakdown at the connection.

Although the electrical connector assembly described in the '915 patent helps to avoid undesired contact of male connector pins 12 and 13, it does not provide protection or shielding to reduce breakdown at the rearward ends of the male connector pins 12, 13 or the rearward ends of the female connector pins 59 and 60. As shown in FIG. 1 of the '915 patent, the conductor 68 is soldered at 69 to the portion of female connector pin 59. The configuration of the '915 patent relies upon a sufficient air separation between soldering joints for the conductor 68 and conductor 70. The size of the air separation is affected by the quality of the soldering joints, which may be performed by a non-professional hobbyist, for example, in the case that the battery-powered device is a remote controlled (RC) car, airplane, helicopter, boat, or other suitable RC device.

Additionally, the electrical connector assembly described in the '915 patent does not protect or shield the rearward ends of the connector pins 12, 13, 59, and 60 from a short-circuit that may be caused by contact with a foreign object. For example, a battery placed in a container with metallic spare parts, keys, or other suitably conductive objects may short-circuit if the air separation between the conductors is effectively reduced by contact with a conductive object.

Another example of an electrical connector assembly is disclosed by Hariharesan et al., U.S. Pat. No. 7,374,460 ("the '460 patent"). The '460 patent generally describes an electrical connector 1000 having a male member 500 with male terminals 600 and a female member 100 with female terminals 200. Retention members 512 are configured to retain the male terminal 600 after assembly into the male member 500. As shown in FIG. 6A of the '460 patent, the male terminals 600 are shielded from each other by the housing 502, thus providing protection from breakdown between the male terminals 600, but the unitary housing and retention members 512 reduce accessibility of the male terminals 600. While the male terminal 600 can be soldered to a conductor before insertion into the male member 500, the retention members 512 impede removal of the male terminal 600 or disconnection of a connected conductor, for example, to perform maintenance, cleaning, or removal of the electrical connector assembly for installation on a different battery or battery-powered device.

SUMMARY

In an embodiment, an electrical connector assembly includes a first connector body, a second connector body, a first removable cap, and a second removable cap. The first connector body has i) a first connector end, ii) a first cap end, and iii) a first electrode and a second electrode that protrude from the first cap end. The first removable cap has a cavity formed by an outer wall portion that shields the first electrode and the second electrode upon an engagement of the first removable cap and the first connector body. The first removable cap has an interior wall portion that shields at least a portion of the first electrode from the second electrode upon the engagement of the first removable cap and the first connector body. The second connector body has i) a second connector end, ii) a second cap end, and iii) a third electrode and a fourth electrode that protrude from the second cap end. The second removable cap has a cavity formed by an outer wall portion that shields the third electrode and the fourth electrode upon an engagement of the second removable cap and the second connector body. The second removable cap has an interior wall portion that shields at least a portion of the third electrode from the fourth electrode upon the engagement of the second removable cap and the second connector body. Upon an engagement of the first connector body and the second connector body, the first connector end abuts the second connector end, the first electrode and the third electrode are electrically connected, and the second electrode and the fourth electrode are electrically connected.

BRIEF DESCRIPTION OF THE DRAWINGS

Various embodiments of the invention are illustrated in the drawings, in which.

DETAILED DESCRIPTION

While various prior art solutions for electrical connector assemblies provide protection to reduce breakdown or short-circuiting of conductors, these solutions impede assembly or disconnection of the conductors within the electrical connector assembly. In embodiments described below, however, an electrical connector assembly provides protection or shielding to reduce breakdown at rearward ends of electrodes and to reduce short-circuiting caused by foreign objects, without impeding the connection or disconnection of a conductor to the electrodes. In an embodiment, an electrical connector assembly includes a first connector body, a first removable cap, a second connector body, and a second removable cap. The connector bodies have respective electrodes that protrude from respective cap ends. The removable caps have respective cavities formed by outer wall portions that shield the electrodes upon engagement of the removable caps with the corresponding connector body. The removable caps have an interior wall portion that shields at least a portion of the electrodes upon the engagement of the removable caps with the corresponding connector body.

Figure 1:
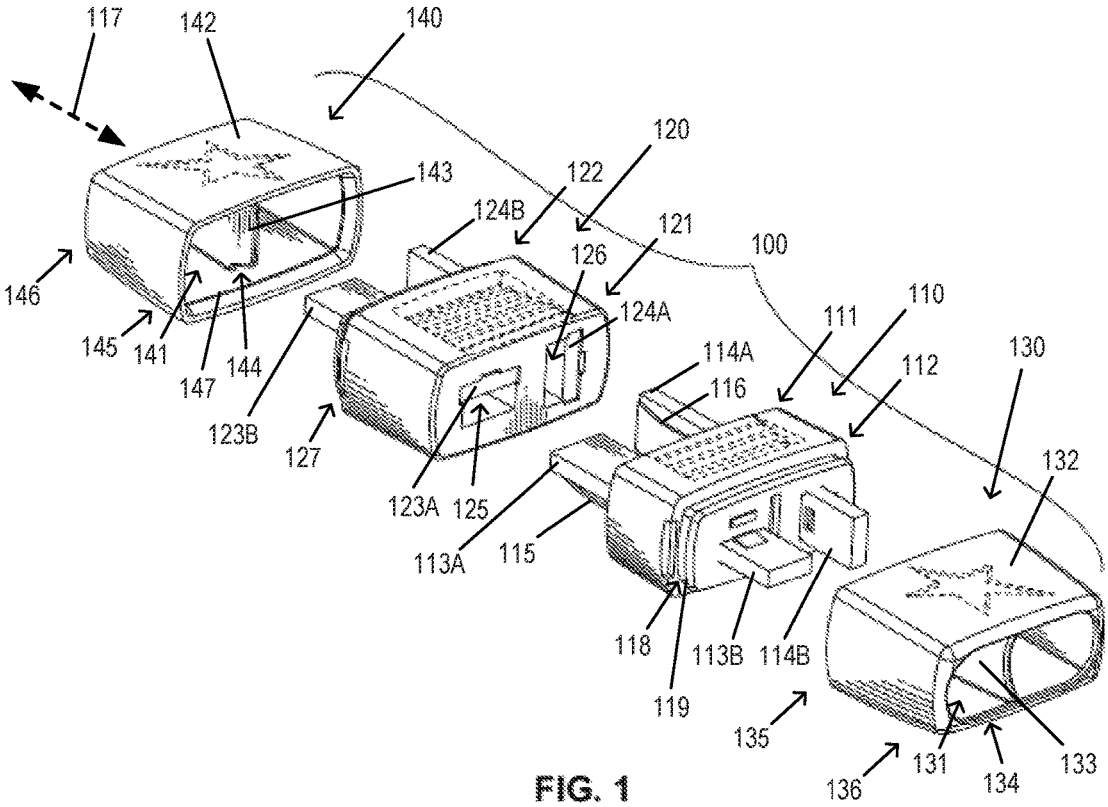
FIG. 1 is an exploded perspective view of an electrical connector assembly, according to an embodiment.
Figure 2:
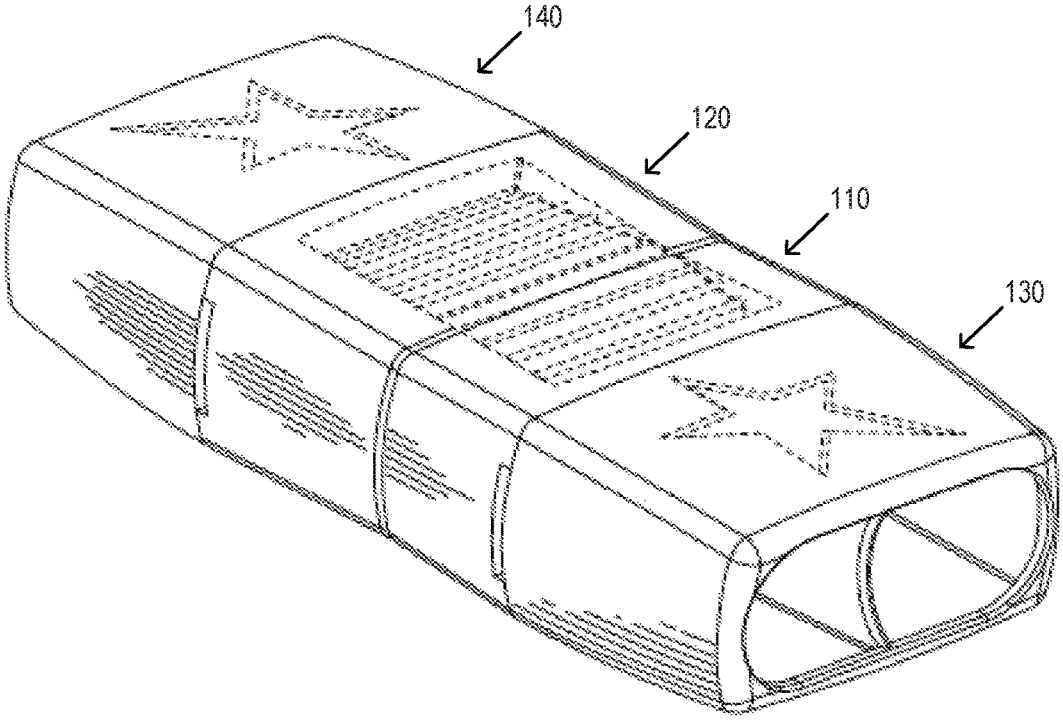
FIG. 2 is a perspective view of the electrical connector assembly of FIG. 1, according to an embodiment.
Figure 3:
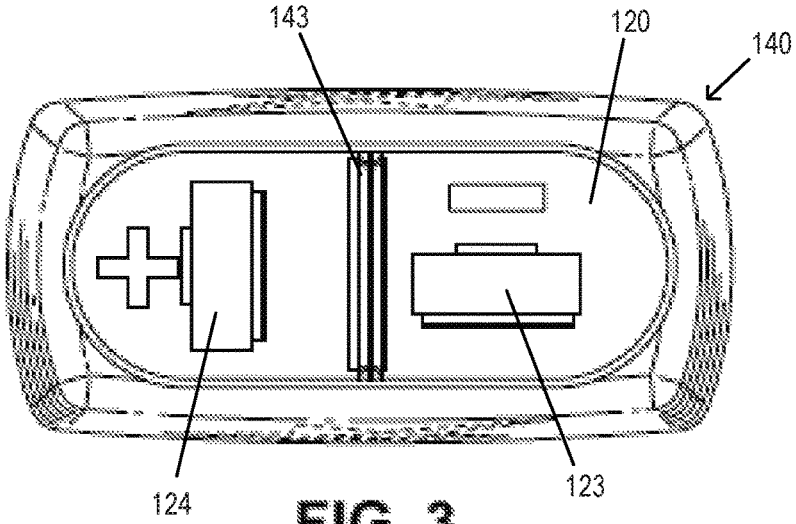
FIG. 3 is right side view of the electrical connector assembly of FIG. 1, according to an embodiment.
Figure 4:
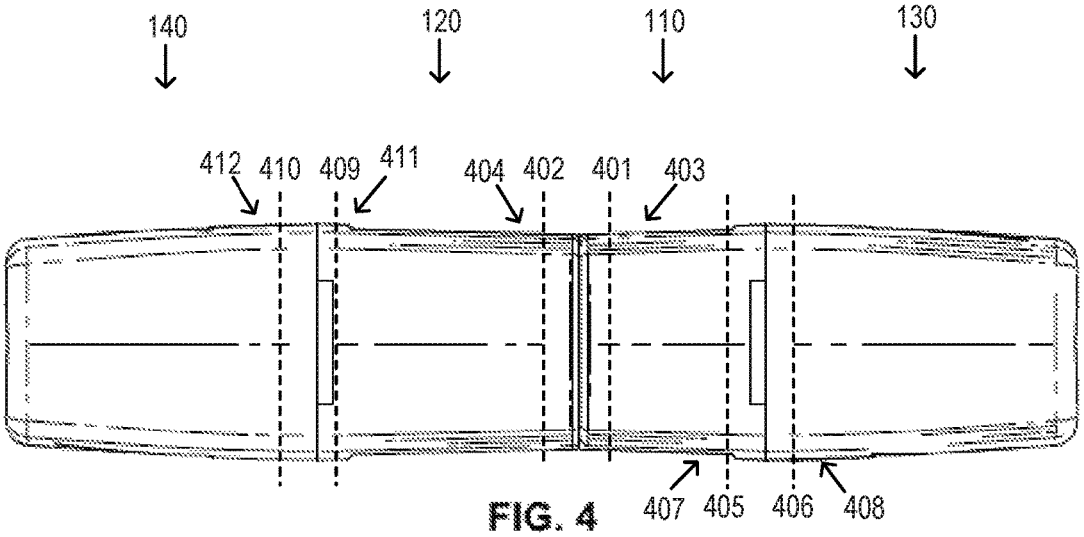
FIG. 4 is a front view of the electrical connector assembly of FIG. 1, according to an embodiment.
Figure 5:
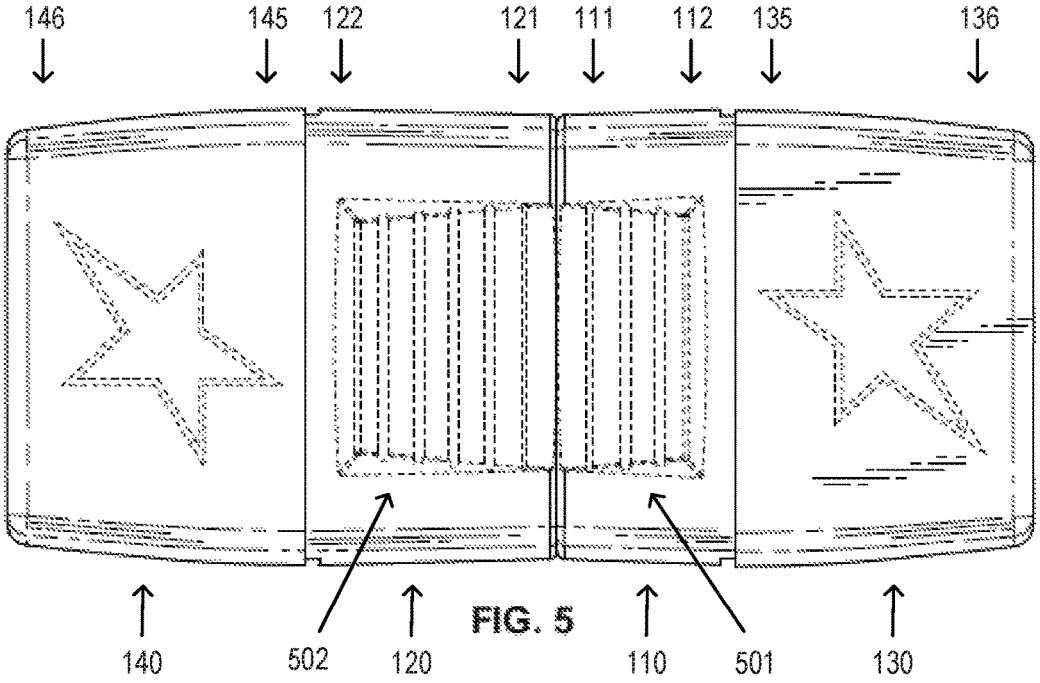
FIG. 5 is a top view of the electrical connector assembly of FIG. 1, according to an embodiment.

FIG. 1 is an exploded perspective view of an electrical connector assembly 100, according to an embodiment. FIG. 2 is a perspective view of the electrical connector assembly 100 of FIG. 1. FIG. 3 is right side view of the electrical connector assembly 100 of FIG. 1. FIG. 4 is a front view of the electrical connector assembly 100 of FIG. 1. FIG. 5 is a top view of the electrical connector assembly 100 of FIG. 1. The electrical connector assembly 100 includes a first connector body 110, a second connector body 120, a first removable cap 130, and a second removable cap 140. The first connector body 110 has a first connector end 111 and a first cap end 112, opposite the first connector end 111. The first connector end 111 is configured to abut the second connector body 120 upon an engagement of the first connector body 110 and the second connector body 120. The first removable cap 130 is configured to be removably attached or secured to the first cap end 112 of the first connector body 110.

The first connector body 110 includes a first electrode 113 and a second electrode 114. The first electrode 113 is an elongated, generally rectangular bar having a top, a bottom, a first side, a second side, a forward end 113A, and a rearward end 113B. The second electrode 114 is an elongated, generally rectangular bar having a top, a bottom, a first side, a second side, a forward end 114A, and a rearward end 114B. The first connector body 110 also includes resilient members 115 and 116, for example, leaf springs, that are coupled with the first electrode 113 and the second electrode 114, respectively.

In the illustrated embodiment, the first connector body 110 is a male connector body. The forward end 113A protrudes from the first connector end 111 and the rearward end 113B protrudes from the first cap end 112. The forward end 114A protrudes from the first connector end 111 and the rearward end 114B protrudes from the first cap end 112. The forward ends 113A and 114A protrude generally parallel to an insertion axis 117 that is normal to an outer face of the first connector end 111. The rearward ends 113B and 114B protrude from the first cap end 112 generally parallel to the insertion axis 117.

The second connector body 120 has a second connector end 121 and a second cap end 122 (e.g., second connector and cap ends of the electrical connector assembly 100), opposite the second connector end 121. The second connector end 121 is configured to abut the first connector body 110 upon an engagement of the first connector body 110 and the second connector body 120. The second removable cap 140 is configured to be removably attached or secured to the second cap end 122 of the second connector body 120.

The second connector body 120 includes a third electrode 123 and a fourth electrode 124 (e.g., third and fourth electrodes of the electrical connector assembly 100). The third electrode 123 is an elongated, generally rectangular bar having a top, a bottom, a first side, a second side, a forward end 123A, and a rearward end 123B. In the illustrated embodiment, the second connector body 120 is a female connector body. The forward end 123A of the third electrode 123 is recessed in a first receptacle 125 of the second connector body 120. The forward end 124A of the fourth electrode 124 is recessed in a second receptacle 126 of the second connector body 120. The rearward ends 123B and 124B protrude from the second cap end 122 generally parallel to the insertion axis 117, analogously to the rearward ends 113B and 114B.

The first connector body 110 and the second connector body 120 have respective recessed exterior faces of the corresponding cap end. The recessed exterior faces have respective exterior lips for engagement with the corresponding removable cap. For example, the first connector body 110 has a recessed exterior face 118 with an exterior lip 119 on the first cap end 112. The exterior lip 119 extends around a perimeter of the recessed exterior face 118 of the first cap end 112. Similarly, the second connector body 120 has a recessed exterior face (not shown) with an exterior lip 127 on the second cap end 122. Referring to FIG. 5, the first connector body 110 and the second connector body 120 have respective ridged portions 501 and 502. An inner surface of the ridged portions 501 and 502 is recessed relative to the first cap end 112 and second cap end 122.

The first removable cap 130 and the second removable cap 140 are generally similar. The first removable cap 130 has a cavity 131 formed by an outer wall portion 132. The outer wall portion 132 generally shields the first electrode 113 and the second electrode 114 upon an engagement of the first removable cap 130 and the first connector body 110. For example, the outer wall portion 132 partially covers or encapsulates the rearward end 113B and the rearward end 114B within the cavity 131. The first removable cap 130 also has an interior wall portion 133 that shields at least a portion of the first electrode 113 from the second electrode 114 upon the engagement of the first removable cap 130 and the first connector body 110. For example, the interior wall portion 133 is disposed between the rearward end 113B and the rearward end 114B to shield the first electrode 113 from the second electrode 114.

The first removable cap 130 has an aperture 134 through which the first electrode 113 is connectable externally to the first removable cap 130 upon the engagement of the first removable cap 130 and the first connector body 110. In the illustrated embodiment, the aperture 134 is disposed at a rearward end 136 of the first removable cap 130, opposite a forward end 135 of the first removable cap 130. The second electrode 114 is also connectable externally to the first removable cap 130 via the aperture 134 upon the engagement of the first removable cap 130 and the first connector body 110.

The second removable cap 140 has a cavity 141 formed by an outer wall portion 142. The outer wall portion 142 generally shields the third electrode 123 and the fourth electrode 124 upon an engagement of the second removable cap 140 and the second connector body 120. For example, the outer wall portion 142 partially covers or encapsulates the rearward end 123B and the rearward end 124B within the cavity 141. The second removable cap 140 also has an interior wall portion 143 that shields at least a portion of the third electrode 123 from the fourth electrode 124 upon the engagement of the second removable cap 140 and the second connector body 120. For example, the interior wall portion 143 is disposed between the rearward end 123B and the rearward end 124B to shield the third electrode 123 from the fourth electrode 124.

The second removable cap 140 has an aperture (not shown) through which the third electrode 123 is connectable externally to the second removable cap 140 upon the engagement of the second removable cap 140 and the second connector body 120. Similar to the first removable cap 130, the aperture of the second removable cap 140 is disposed at a rearward end 146 of the second removable cap 146, opposite a forward end 145 of the second removable cap 140. The fourth electrode 124 is also connectable externally to the second removable cap 140 via the aperture of the second removable cap 140, upon the engagement of the second removable cap 140 and the second connector body 120.

In the illustrated embodiment, the interior wall portions 133 and 143 are formed with notches, such as notch 144, along an interior surface of the respective end cap. The first end cap 130 and second end cap 140 also have respective interior lips, such as interior lip 147 of the second end cap 140. The interior lip 147 extends around a perimeter of an internal face of the second removable cap 140. The first end cap 130 has a similar interior lip (not shown). The interior lip of the first end cap 130 provides a snap-fit engagement with the exterior lip 119 of the first connector body 110 to secure the first removable cap 130 to the first connector body 110 upon the engagement of the first removable cap 130 and the first connector body 110. Similarly, the interior lip 147 provides a snap-fit engagement with the exterior lip 127 to secure the second removable cap 140 to the second connector body 130.

Upon the engagement of the first connector body 110 and the second connector body 120 (e.g., a plugged together state), the first connector end 111 abuts the second connector end 121, the first electrode 113 and the third electrode 123 are electrically connected, and the second electrode 114 and the fourth electrode 124 are electrically connected. In the illustrated embodiment, the first connector end 111 and second connector end 121 each have a flat face that provide a flush engagement interface. The interior wall portion 133 of the first removable cap 130 abuts the first cap end 112 upon the engagement of the first removable cap 130 and the first connector body 110. Similarly, the interior wall portion 143 of the second removable cap 140 abuts the second cap end 122 upon the engagement of the second removable cap 140 and the second connector body 120.

The first receptacle 125 receives the first electrode 113 upon the engagement of the first connector body 110 and the second connector body 120. The second receptacle 126 receives the second electrode 114 upon the engagement of the first connector body 110 and the second connector body 120. The resilient member 115 contacts an interior wall of the first receptacle 125, thereby forcing the resilient member 115 and thus the electrode 113 against the electrode 123. The resilient member 116 contacts an interior wall of the second receptacle 126, thereby forcing the resilient member 116 and thus the electrode 114 against the electrode 124.

The first electrode 113 and the third electrode 123 are disposed so that the top of the first electrode 113 abuts the bottom of the third electrode 123 upon the engagement of the first connector body 110 and the second connector body 120. The second electrode 114 and the fourth electrode 124 are disposed orthogonally about the insertion axis 117 relative to the first electrode 113 and the third electrode 123. The second electrode 114 and the fourth electrode 124 are also disposed so that the top of the second electrode 114 abuts the bottom of the fourth electrode 124 upon the engagement of the first connector body 110 and the second connector body 120.

The electrodes 113, 114, 123, and 124 are connectable externally to the electrical connector assembly 100 at their respective rearward portions 113B, 114B, 123B, and 124B. The electrodes 113, 114, 123, and 124 thus provide an external connection to a battery and/or battery-powered device via conductors (not shown) attached to the electrodes 113, 114, 123, and 124. In other words, a battery and battery-powered device (not shown) are electrically connected via the electrodes 113 and 114 and the electrodes 123 and 124. In the illustrated embodiment, the electrodes 113 and 123 provide a negative or ground electrical connection, while the electrodes 114 and 124 provide a positive electrical connection.

Referring to FIG. 4, an outer circumference of the first connector body 110 at the first connector end 111 (along line 401) and an outer circumference of the second connector body 120 at the second connector end 121 (along line 402) are substantially the same. In the plugged together state, an outer surface 403 of the first connector end 111 is substantially flush with an outer surface 404 of the second connector end 121. The first connector end 111 and the second connector end 121 have a substantially same outer circumference. The first cap end 112 and the second cap 122 end have a substantially same outer circumference. The outer circumference of the first connector end 111 and the second connector end 121 is less than the outer circumference of the first cap end 112 and the second cap end 122.

An outer circumference of the first connector body 110 at the first cap end 112 (along line 405) and an outer circumference of the first removable cap 130 at the forward end 135 (along line 406) are substantially the same. In a connected state, upon engagement of the first removable cap 130 with the first connector body 110, an outer surface 407 of the first connector body 110 at the first cap end 112 is substantially flush with an outer surface 408 of the first removable cap 130 at the forward end 135. An outer circumference of the second connector body 120 at the second cap end 122 (along line 409) and an outer circumference of the second removable cap 140 at the forward end 145 (along line 410) are substantially the same. In a connected state, upon engagement of the second removable cap 140 with the second connector body 120, an outer surface 411 of the second connector body 120 at the second cap end 122 is substantially flush with an outer surface 412 of the second removable cap 140 at the forward end 145. In the illustrated embodiment, the outer circumference of the forward ends 135 and 145 have a substantially same circumference that is larger than an outer circumference of the rearward ends 136 and 146.

All references, including publications, patent applications, and patents, cited herein are hereby incorporated by reference to the same extent as if each reference were individually and specifically indicated to be incorporated by reference and were set forth in its entirety herein.

For the purposes of promoting an understanding of the principles of the invention, reference has been made to the embodiments illustrated in the drawings, and specific language has been used to describe these embodiments. However, no limitation of the scope of the invention is intended by this specific language, and the invention should be construed to encompass all embodiments that would normally occur to one of ordinary skill in the art. The terminology used herein is for the purpose of describing the particular embodiments and is not intended to be limiting of exemplary embodiments of the invention. In the description of the embodiments, certain detailed explanations of related art are omitted when it is deemed that they may unnecessarily obscure the essence of the invention.

The use of any and all examples, or exemplary language (e.g., "such as") provided herein, is intended merely to better illuminate the invention and does not pose a limitation on the scope of the invention unless otherwise claimed. Numerous modifications and adaptations will be readily apparent to those of ordinary skill in this art without departing from the spirit and scope of the invention as defined by the following claims. Therefore, the scope of the invention is defined not by the detailed description of the invention but by the following claims, and all differences within the scope will be construed as being included in the invention.

No item or component is essential to the practice of the invention unless the element is specifically described as "essential" or "critical". It will also be recognized that the terms "comprises," "comprising," "includes," "including," "has," and "having," as used herein, are specifically intended to be read as open-ended terms of art. The use of the terms "a" and "an" and "the" and similar referents in the context of describing the invention (especially in the context of the following claims) are to be construed to cover both the singular and the plural, unless the context clearly indicates otherwise. In addition, it should be understood that although the terms "first," "second," etc. may be used herein to describe various elements, these elements should not be limited by these terms, which are only used to distinguish one element from another. Furthermore, recitation of ranges of values herein are merely intended to serve as a shorthand method of referring individually to each separate value falling within the range, unless otherwise indicated herein, and each separate value is incorporated into the specification as if it were individually recited herein.

What is claimed is:

1. An electrical connector assembly, comprising:

a male connector body having i) a first connector end, ii) a first cap end, and iii) a first electrode and a second electrode having respective cap end portions that protrude from the first cap end and respective connector end portions that protrude from the first connector end;

a first removable cap having a cavity formed by an outer wall portion that shields the cap end portions of the first electrode and the second electrode upon an engagement of the first removable cap and the first cap end of the male connector body, the first removable cap having an interior wall portion that shields at least a portion of the cap end portion of the first electrode from the cap end portion of the second electrode upon the engagement of the first removable cap and the male connector body;

a female connector body having i) a second connector end, ii) a second cap end, iii) a first receptacle and a second receptacle at the second connector end that respectively receive the connector end portions of the first and second electrodes upon an engagement of the male connector body and the female connector body, iv) a third electrode and a fourth electrode having respective cap end portions that protrude from the second cap end and respective connector end portions that are respectively recessed in the first and second receptacles;

a second removable cap having a cavity formed by an outer wall portion that shields the cap end portions of the third electrode and the fourth electrode upon an engagement of the second removable cap and the second cap end of the female connector body, the second removable cap having an interior wall portion that shields at least a portion of the third electrode from the fourth electrode upon the engagement of the second removable cap and the female connector body;

wherein, upon the engagement of the male connector body and the female connector body, the first connector end abuts the second connector end, the first electrode and the third electrode are electrically connected, and the second electrode and the fourth electrode are electrically connected;

wherein:

the first removable cap has an aperture through which the first electrode is connectable externally to the first removable cap upon the engagement of the first removable cap and the male connector body;

the first removable cap has a forward end that abuts the male connector body and a rearward end opposite the forward end;

the aperture is disposed at the rearward end;

an outer surface of the forward end of the first removable cap is substantially flush with an outer surface of the first cap end upon the engagement of the first removable cap and the male connector body.

2. The electrical connector assembly of claim 1, wherein:

the first cap end has an exterior lip; and the forward end of the first removable cap has an interior lip that provide a snap-fit engagement with the exterior lip to secure the first removable cap to the male connector body upon the engagement of the first removable cap and the male connector body.

3. The electrical connector assembly of claim 2, wherein the exterior lip is formed on a recessed exterior face of the first cap end.

4. The electrical connector assembly of claim 3, wherein the exterior lip extends around a perimeter of the recessed exterior face of the first cap end.

5. The electrical connector assembly of claim 4, wherein the interior lip extends around a perimeter of an internal face of the first removable cap.

6. The electrical connector assembly of claim 1, wherein an outer circumference of the forward end is larger than an outer circumference of the rearward end.

7. The electrical connector assembly of claim 1, wherein:

the first cap end and the second cap end have a substantially same outer circumference; and the first connector end and the second connector end have a substantially same outer circumference that is less than the outer circumference of the first cap end and the second cap end.

8. The electrical connector assembly of claim 1, wherein upon the engagement of the first removable cap and the first cap end of the male connector body, the interior wall portion of the first removable cap abuts a face of the first cap end.

9. The electrical connector assembly of claim 8, wherein upon the engagement of the first removable cap and the first cap end of the male connector body, the interior wall portion of the first removable cap abuts a face of the first cap end;

wherein, upon the engagement of the second removable cap and the second cap end of the female connector body, the interior wall portion of the second removable cap abuts a face of the second cap end.

10. The electrical connector assembly of claim 9, wherein the interior wall portion of the first removable cap is formed with notches along an interior surface of the first removable cap;

wherein the interior wall portion of the second removable cap is formed with notches along an interior surface of the second removable cap.

11. The electrical connector assembly of claim 9, wherein upon the engagement of the first removable cap and the first cap end of the male connector body, the interior wall portion of the first removable cap is disposed between the cap end portions of the first and second electrodes;

wherein upon the engagement of the second removable cap and the second cap end of the female connector body, the interior wall portion of the second removable cap is disposed between the cap end portions of the third and fourth electrodes.

12. The electrical connector assembly of claim 1, wherein the first removable cap has an aperture through which the second electrode is connectable externally to the first removable cap upon the engagement of the first removable cap and the male connector body.

13. The electrical connector assembly of claim 1, wherein:

the first electrode is an elongated, generally rectangular bar having a top, a bottom, a first side, a second side, a forward end, and a rearward end;

the third electrode is an elongated, generally rectangular bar having a top, a bottom, a first side, a second side, a forward end, and a rearward end;

the first electrode and the third electrode are disposed so that the top of the first electrode abuts the bottom of the third electrode upon the engagement of the male connector body and the female connector body;

the second electrode is an elongated, generally rectangular bar having a top, a bottom, a first side, a second side, a forward end, and a rearward end;

the fourth electrode is an elongated, generally rectangular bar having a top, a bottom, a first side, a second side, a forward end, and a rearward end;

the second electrode and the fourth electrode are disposed i) orthogonally about an insertion axis of the male connector body relative to the first electrode and the third electrode, and ii) so that the top of the second electrode abuts the bottom of the fourth electrode upon the engagement of the male connector body and the female connector body.

14. The electrical connector assembly of claim 1, wherein upon the engagement of the first removable cap and the first cap end of the male connector body, the interior wall portion of the first removable cap shields substantially all of the cap end portions of the first electrode and the second electrode from each other;

wherein upon the engagement of the second removable cap and the second cap end of the female connector body, the interior wall portion of the second removable cap shields substantially all of the cap end portions of the third electrode and the fourth electrode from each other.

* * * * *